US011310587B2

(12) United States Patent
Blore et al.

(10) Patent No.: US 11,310,587 B2
(45) Date of Patent: Apr. 19, 2022

(54) HORN LOUDSPEAKERS

(71) Applicant: Bose Corporation, Framingham, MA (US)

(72) Inventors: David Edwards Blore, Westborough, MA (US); Randy J. Kulchy, Shrewsbury, MA (US); Robert Preston Parker, Westborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/595,723

(22) Filed: Oct. 8, 2019

(65) Prior Publication Data

US 2021/0105557 A1 Apr. 8, 2021

(51) Int. Cl.
*H04R 1/36* (2006.01)
*H04R 1/28* (2006.01)

(52) U.S. Cl.
CPC ..... *H04R 1/2865* (2013.01); *H04R 1/2849* (2013.01); *H04R 1/2873* (2013.01)

(58) Field of Classification Search
CPC ..... H04R 1/26; H04R 1/30; H04R 1/2826; H04R 1/2849; H04R 1/2876; G10K 11/025
See application file for complete search history.

(56) References Cited

U.S. PATENT DOCUMENTS 4,206,831 A * 6/1980 Welch ..... G10K 11/025 181/159
4,893,695 A * 1/1990 Tamura ..... H04R 1/30 181/151
5,115,883 A * 5/1992 Morikawa ..... H04R 1/30 181/152
5,233,136 A * 8/1993 Hamada ..... H04R 1/30 181/152
5,432,860 A * 7/1995 Kasajima ..... H04R 1/30 181/152
5,793,000 A * 8/1998 Sabato ..... H04R 1/025 181/151
6,116,373 A * 9/2000 Dodd ..... G10K 11/025 181/151
8,457,341 B2 * 6/2013 Danley ..... H04R 1/2865 381/340
8,607,922 B1 12/2013 Werner
8,831,263 B2 9/2014 Parker et al.
9,473,848 B2 * 10/2016 Chick ..... H04R 1/2853
9,479,861 B2 * 10/2016 Bisset ..... H04R 1/2842
(Continued)

FOREIGN PATENT DOCUMENTS

EP 0339425 A2 11/1989
EP 1041538 A1 10/2000

OTHER PUBLICATIONS

International Search Report and Written Opinion dated Feb. 2, 2021 for PCT PCT/US20/54480.

*Primary Examiner* — Ryan Robinson
(74) *Attorney, Agent, or Firm* — Bose Corporation

(57) ABSTRACT

A loudspeaker includes a first electro-acoustic transducer, a horn acoustically coupled to the first electro-acoustic transducer, and a first acoustic leak that is acoustically coupled to the horn. The first acoustic leak is positioned so as to reduce a peak in a frequency response of the loudspeaker at the targeted frequency without removing the targeted frequency from the output of the loudspeaker.

19 Claims, 13 Drawing Sheets

(56) References Cited

U.S. PATENT DOCUMENTS

| | | | | |
|---|---|---|---|---|
| 9,538,282 | B2 * | 1/2017 | DeLay | G10K 13/00 |
| 9,906,855 | B2 | 2/2018 | Lage et al. | |
| 9,913,024 | B2 | 3/2018 | Lage et al. | |
| 10,231,049 | B2 * | 3/2019 | Spero | H04R 1/2803 |

* cited by examiner

HORN LOUDSPEAKERS

BACKGROUND

This disclosure relates to horn loudspeakers. More particularly, this disclosure relates to a horn loudspeaker that is provided with one or acoustic leaks along a length of the horn to reduce comb filtering in the output of the loudspeaker.

SUMMARY

All examples and features mentioned below can be combined in any technically possible way.

In one aspect, a loudspeaker includes a first electro-acoustic transducer, a horn acoustically coupled to the first electro-acoustic transducer, and a first acoustic leak that is acoustically coupled to the horn. The first acoustic leak is positioned so as to reduce a peak in a frequency response of the loudspeaker at the targeted frequency without removing the targeted frequency from the output of the loudspeaker Implementations may include one of the following features, or any combination thereof.

In some implementations, the first acoustic leak includes an acoustic resistive element within a first sidewall of the horn.

In certain implementations, the first acoustic leak includes a sealed back enclosure disposed along an outer surface of the horn.

In some cases, the first acoustic leak includes an acoustically absorbent material disposed within the sealed back enclosure. The acoustically absorbent material broadens out the affected frequency bandwidth, effectively lowering the quality factor, Q, of the first acoustic leak.

In certain cases, the acoustically absorbent material includes a cotton batting, a synthetic fiber batting, or an acoustically absorbent foam.

In some examples, the first acoustic leak comprises a ¼λ stub that defines an acoustic channel that has a length that is ¼ the wavelength (λ) of the target frequency.

In certain examples, the ¼λ stub is in the form of a tube that circumferentially surrounds the horn.

In some implementations, the ¼λ stub includes an open end that is acoustically coupled to the horn via on or more apertures, a closed end, opposite the open end, and a body that extends substantially parallel to the outer surface of the horn between the open and closed ends.

In certain implementations, the ¼λ stub includes an acoustically absorbent material disposed within the acoustic channel. The acoustically absorbent material broadens out the affected frequency bandwidth, effectively lowering the quality factor, Q, of the first acoustic leak.

In some cases, the first acoustic leak includes a Helmholtz absorber. The Helmholtz absorber includes an enclosed volume; a port having a first end that is acoustically coupled to the horn and a second end, opposite the first end, that is acoustically coupled to the enclosed volume; and an acoustically absorbent material disposed within the acoustic channel.

In some examples, the loudspeaker includes a second acoustic leak. The first acoustic leak and the second acoustic leak are configured for reducing different, respective peaks in the output of the loudspeaker.

In certain examples, the horn includes a first horn section and a second horn section. The first acoustic leak is configured to reduce a first peak in the output of the loudspeaker corresponding to a first resonance in the first horn section and the second acoustic leak is configured to reduce a second peak in the output of the loudspeaker corresponding to a second resonance in the second horn section.

In some cases, the first acoustic leak is disposed in first horn section.

In certain cases, the first acoustic leak is arranged such that it is closer to an interface of first and second horn sections than it is to the first electro-acoustic driver.

In some examples, the acoustic resistive element includes a metallic screen.

In certain examples, the loudspeaker includes an acoustic enclosure, and a second electro-acoustic transducer. The first electro-acoustic transducer, the horn, and the second electro-acoustic transducer are supported in the acoustic enclosure.

In some implementations, the first electro-acoustic transducer is a high-frequency driver and second electro-acoustic transducer is a low-frequency driver.

Figure 1:
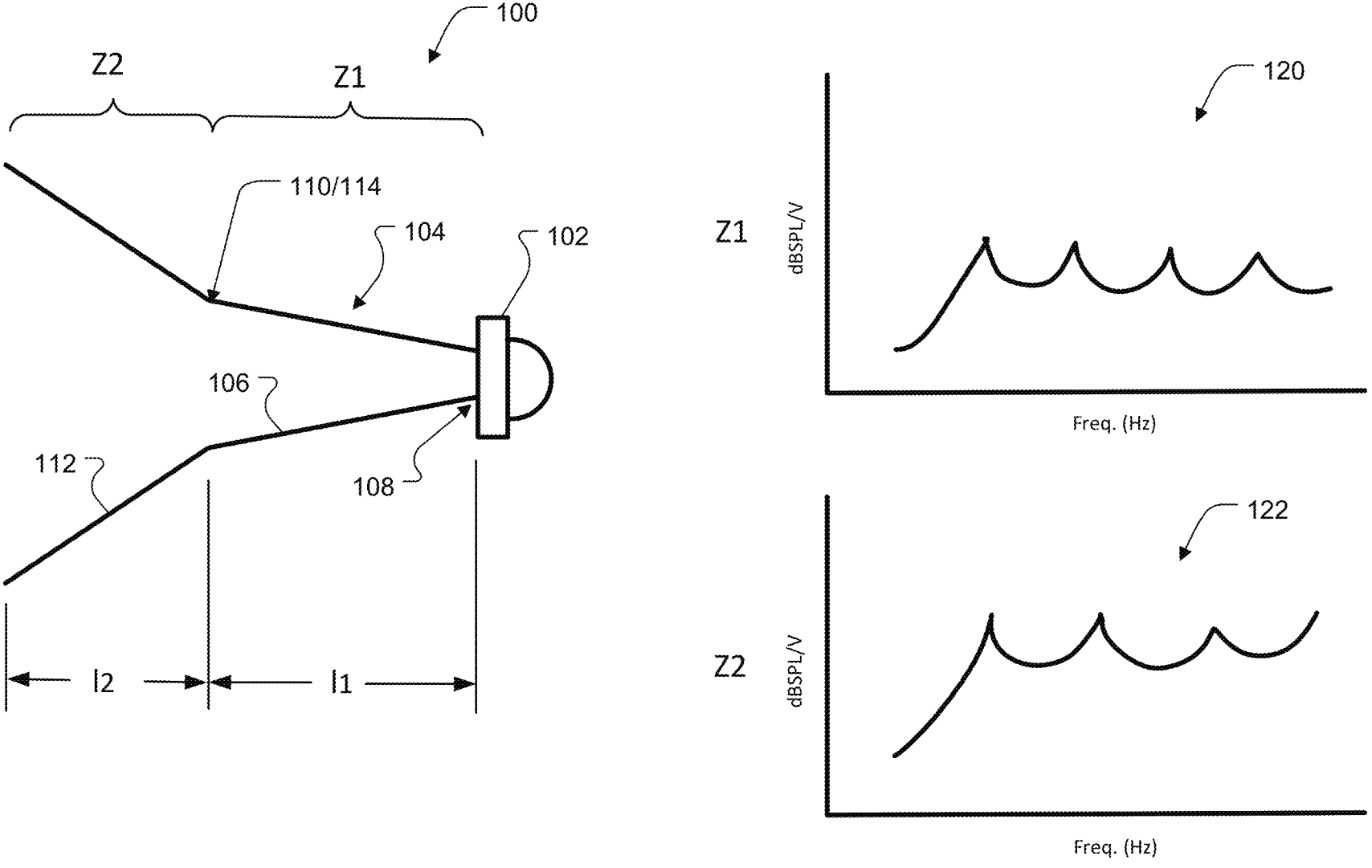
FIG. 1 is a diagrammatic side view of a conventional horn loudspeaker.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

FIG. 1 illustrates a conventional horn loudspeaker 100 that includes an electro-acoustic transducer 102 (e.g., a compression driver) and a horn 104. As shown in the figure, a standard compression driver horn 104 has two (2) sections, Z1 and Z2. A first section Z1 having a length 11 couples the electro-acoustic transducer 102 to the second section Z2. The first section Z1 includes a sidewall 106 (a/k/a "first sidewall") that defines a first acoustic path that extends from a first open end (a/k/a "inlet" or "throat") 108, which is coupled to the electro-acoustic transducer 102, to a second open end (a/k/a "outlet") 110, which is coupled to the second section Z2. Similarly, the second section Z2 having a length 12 includes a sidewall 112 (a/k/a "second sidewall") that defines a second conical acoustic path, which is in acoustic communication with the first acoustic path. The second conical acoustic path extends from an inlet 114 at one end to an outlet (a/k/a "mouth") 116 at an opposite end.

Due to respective flare rate changes in the horn expansion and finite lengths of the horn sections Z1 and Z2, ripples (a/k/a "impedance peaks" or simply "peaks") are produced in the frequency response resulting in comb filtering. In realizable horns, the length is not infinite resulting in an impedance mismatch at the mouth of the horn and at discontinuities in the horn flare rate. The real acoustic impedance at the throat will have impedance peaks and dips from this mismatch often described as comb filtering.

The resonance frequencies can be approximated by:

$$f_n \cong \left(\frac{c}{2*l_p}\right)\sqrt{n^2+\left(\frac{l_p}{\pi*h}\right)^2}$$

where n=1, 2, 3 . . . , $l_p$=effective length of horn, and h=flare constant.

To the right of the loudspeaker 100 in FIG. 1 are graphs 120, 122 of the frequency responses for the first and second horn sections Z1, Z2 illustrating this comb filtering effect.

This disclosure is based, at least in part, on the realization that one or more acoustic leaks may be provided along a length of a horn to help reduce peaks in the frequency response in order to provide a smoother frequency response.

Figure 2A:
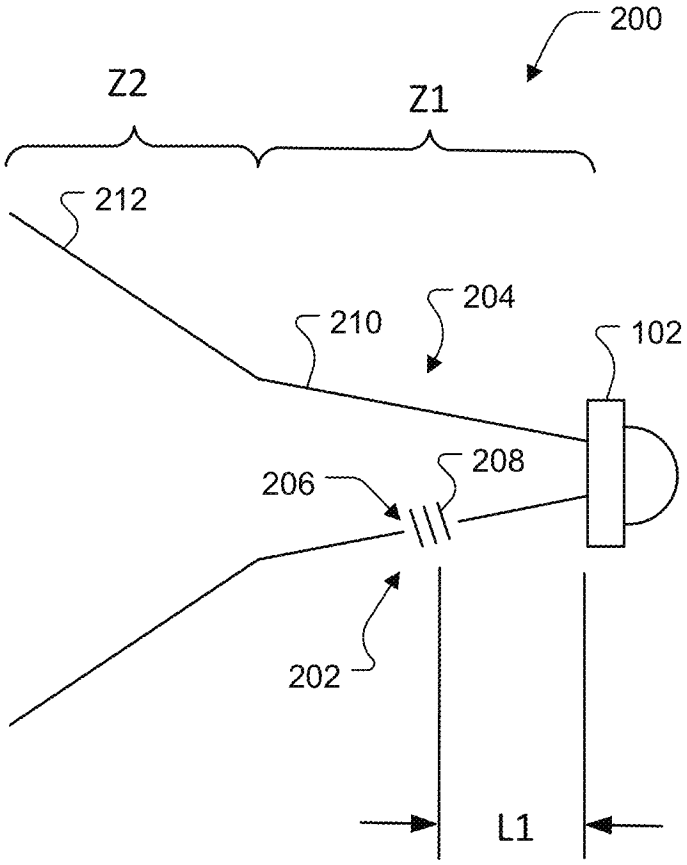
FIG. 2A is a diagrammatic side view of a horn loudspeaker that includes an acoustic leak that is vented to open space.

FIG. 2A illustrates an example of a horn loudspeaker 200 that is provided with an acoustic leak 202 along the length of its horn 204. The loudspeaker 200 generally has a similar construction as the loudspeaker 100 described above with reference to FIG. 1, with the exception that an opening 206 is provided at location L1 through which acoustic energy can leak out of the horn 204. Here, L1 refers to the distance from the throat of the horn 204 to the center of the opening 206. The opening 206 is covered with an acoustic resistive element 208 (represented schematically with parallel-dashed lines) which may be applied along the outer or inner surface of the horn sidewalls 210, 212. In the illustrated example, the acoustic leak 202 is positioned within the first section Z1 of the horn 204; however, it could also be located in the second section Z2 of the horn 204. The location of the acoustic leak 202 controls how much of the target frequency peak is reduced (cut). Ideally the acoustic leak 202 is located not for a maximum (most effective) reduction of the targeted frequency, but, instead, to simply reduce the peak in the target frequency enough to provide a smooth response. Various types of structures may be employed for producing one or more acoustic resistive elements. For example, a single layer element (e.g., a single layer screen) or a multi-layer element (e.g., stacked screens) may be designed and used. For a multi-layer resistive element, one or more separation distances may be employed for the design. Further, air may be allowed to flow between the multiple layers, or, one or more materials may be used to create structures between the screens. For example, different patterns (e.g., ridges, channels, etc.) may be incorporated into structures positioned between screen pairs. Such screens can also incorporate one or more geometries (e.g., generally rectangular shapes, etc.).

Various types of materials may be used for producing resistive elements to dampen the effects of the acoustical characteristics of the port interfaces and channels. For example, one or more screens included in the resistive element 208 may be metallic in composition and include one or more metals (along with other types of materials in some arrangements). A substantially solid metal layer (or layers) may be used to produce a screen. Meshes and other types of pattern designs may be employed in one or more screens. One or more fabrics may be employed in the resistive element; for example, a relatively stiff fabric may be used that is capable to withstanding the environmental effects (e.g., temperatures, sound pressures, vibrations, etc.) of the transducer array enclosure 300. Composite materials may also be used to create a screen, a screen frame, or other structural components of the resistive element 322. Combinations of different materials may also be used for producing components of the resistive element 208; for example, one or more composites (e.g., plastics) and metals may be employed.

Figure 2B:
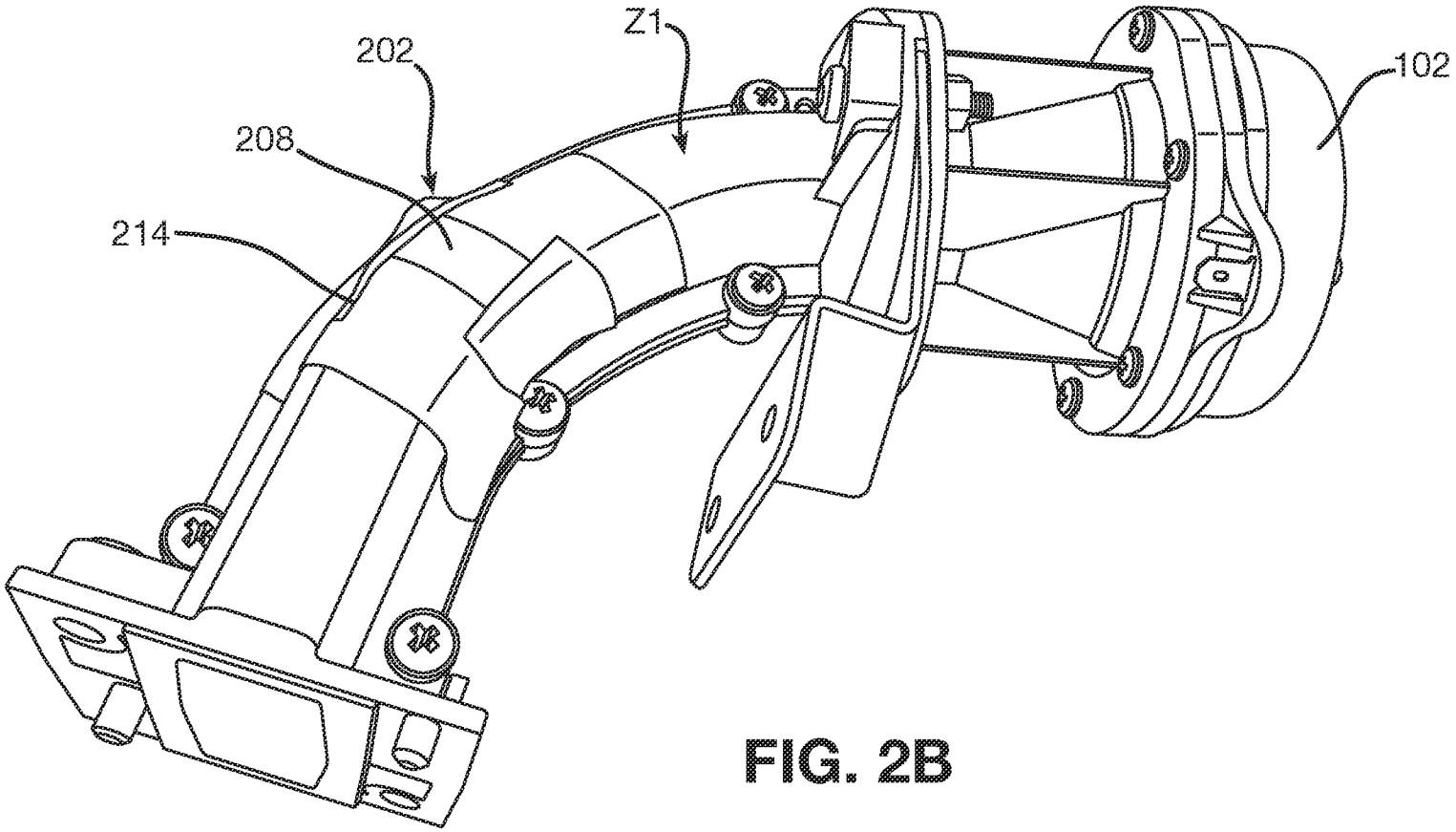
FIGS. 2B-2D are photographs of a portion of a horn loudspeaker constructed according to the implementation illustrated in FIG. 2A.
Figure 2C:
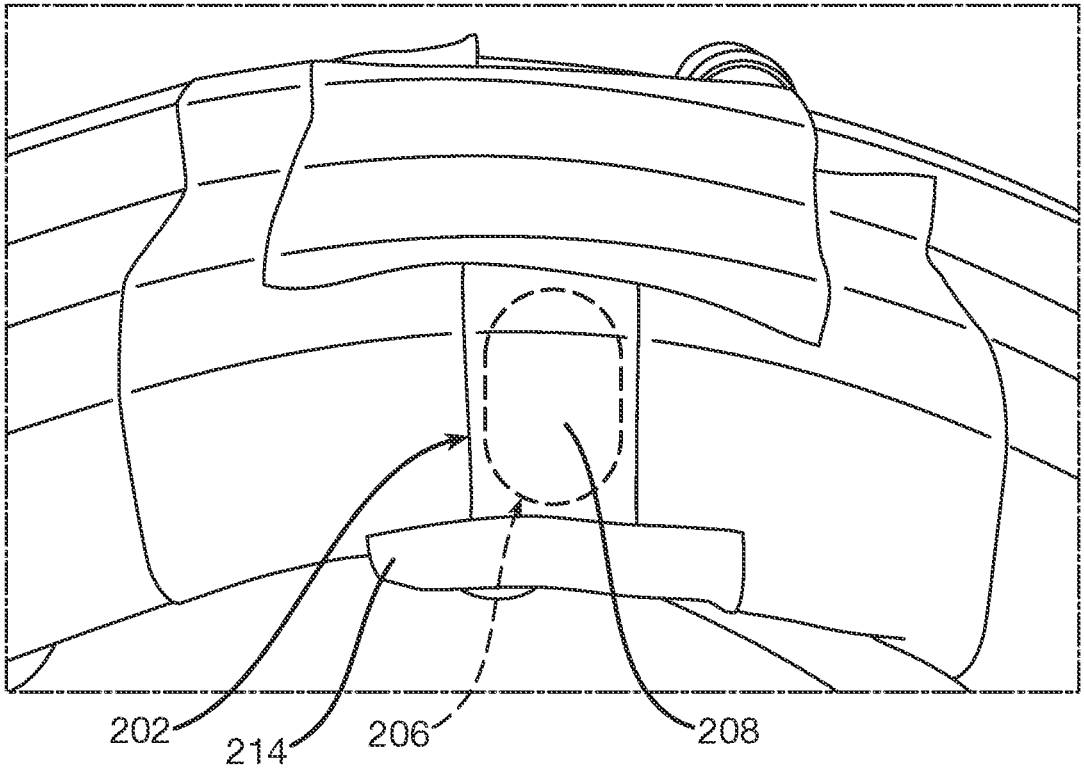
Figure 2D:
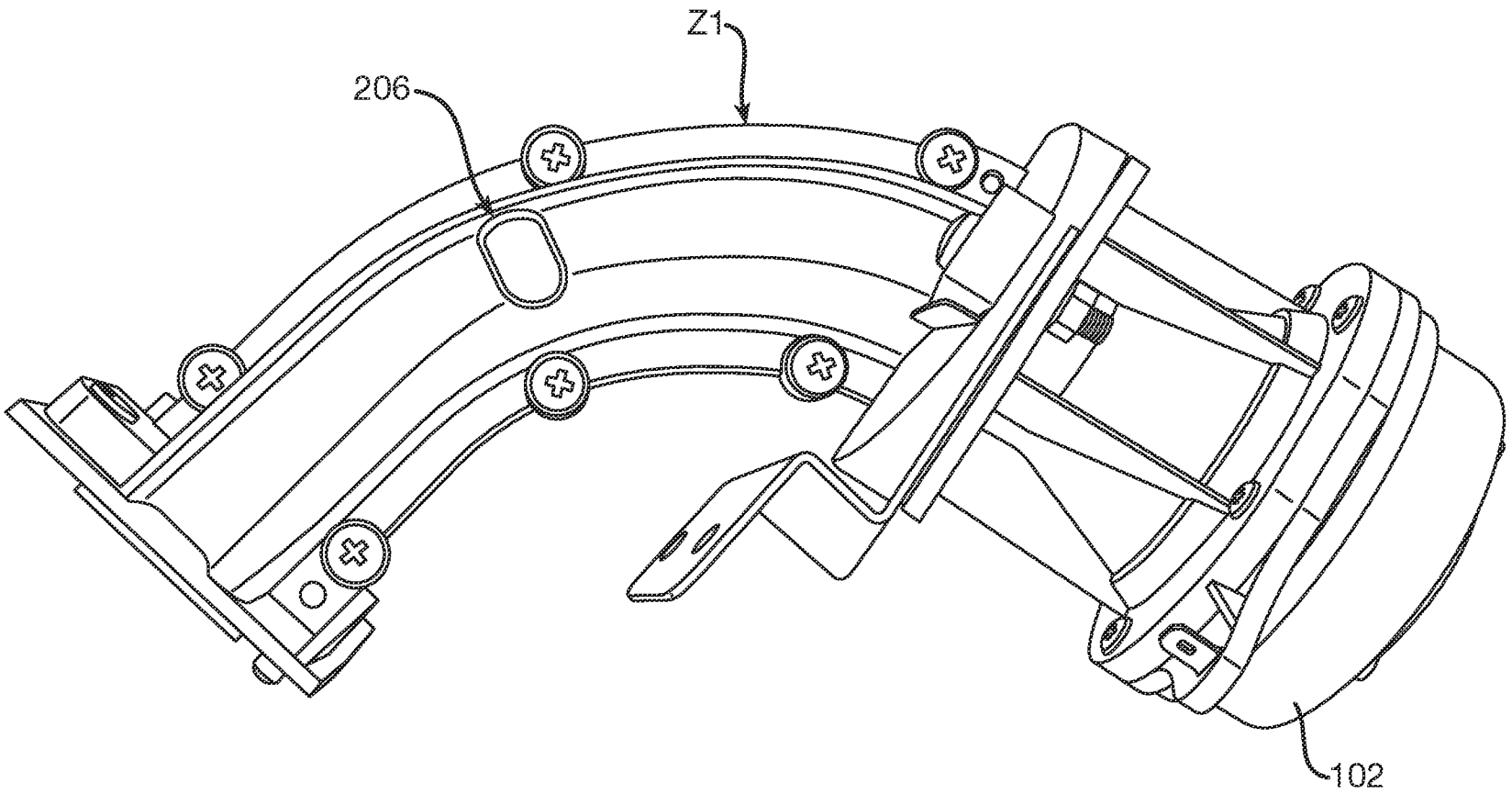

FIGS. 2B-2D are photographs of a portion of a loudspeaker constructed according to the implementation illustrated in FIG. 2A. The photographs show a first horn section Z1 of the loudspeaker 200 with an acoustic leak 202 that is vented to free air via an opening 206 (FIGS. 2C & 2D) in the first horn section Z1 (a/k/a adapter)). The first horn section Z1 is coupled to the electro-acoustic transducer 102. The second horn section Z2 is omitted from FIGS. 2B-2D for clarity. An acoustic resistive element 208 covers the opening 206. The acoustic resistive element 208 may be secured to the inner surface or the outer surface of the horn 204, e.g., with an adhesive. In FIGS. 2B & 2C, the acoustic resistive element 208 is shown secured to the outer surface of the first horn section Z1 with tape 214. Alternatively, the horn 204, or a portion thereof, e.g., the first horn section Z1 or second horn section Z2, may be formed (e.g., molded) around the acoustic resistive element 208, e.g., in an insert molding process.

Figure 3:
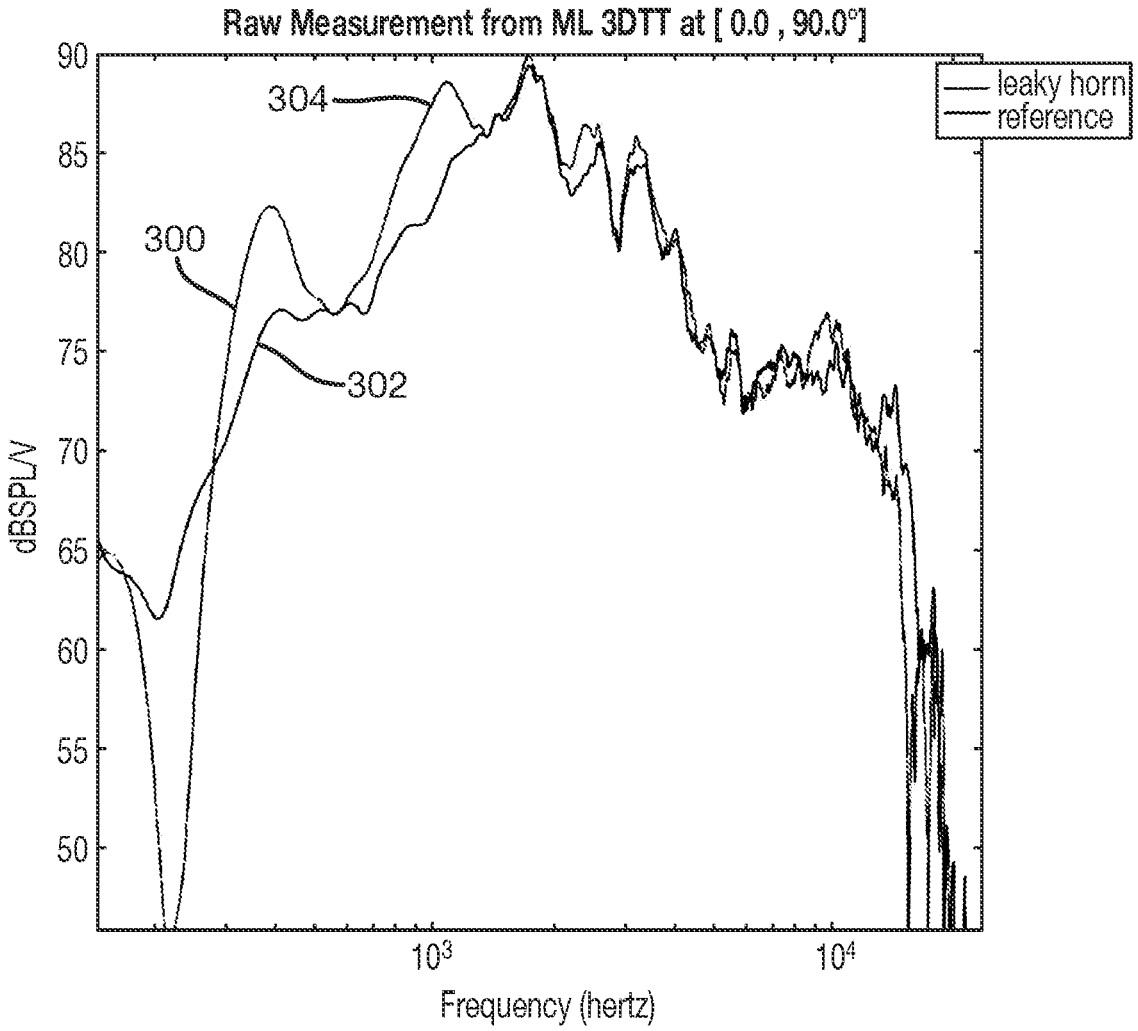
FIG. 3 is frequency response graph that plots responses from the horn loudspeakers illustrated in FIGS. 1 and 2A.

FIG. 3 illustrates a plot 300 of the frequency response of the configuration of FIG. 1 (reference horn) and a plot 302 of the frequency response of the configuration of FIG. 2B when coupled to a second horn section Z2 (leaky horn). The plot for the reference horn shows a peak 304 of between 85-90 dBSPL/V at around 1 kHz. By way of comparison, the plot 302 for the leaky horn illustrates that the addition of a leak in the first horn section Z1 helps to reduce the peak 304 at about 1 kHz, the targeted frequency, to provide a smoother response in the 1 kHz region. Notably, the peak 304 is reduced without totally eliminating energy in the 1 kHz frequency range in the response.

Figure 4A:
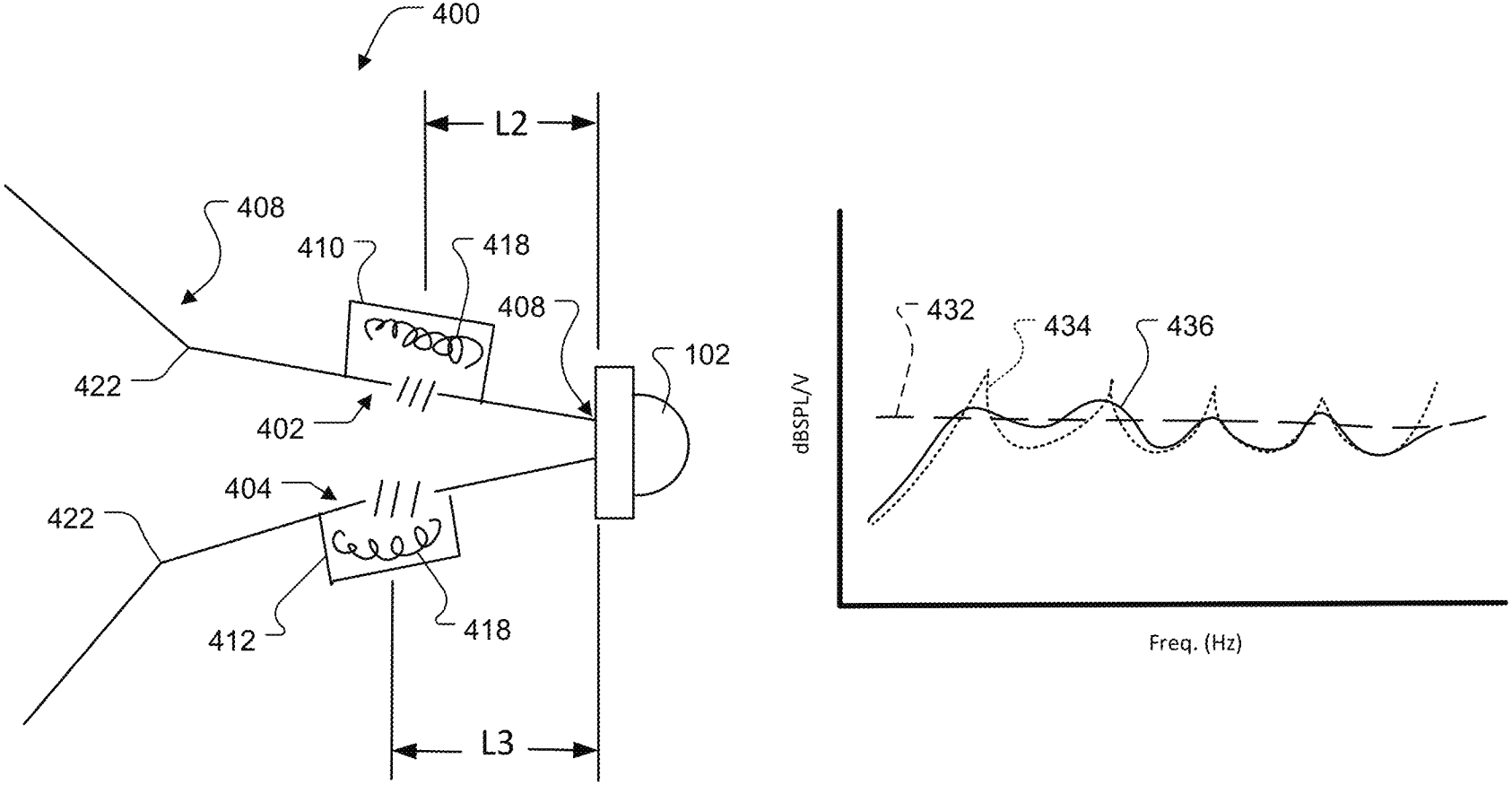
FIG. 4A is a diagrammatic view of an implementation of a horn loudspeaker that includes acoustic leaks which are vented to respective sealed back enclosures.

FIG. 4A illustrates another implementation of a horn loudspeaker 400. In the implementation illustrated in FIG. 4A, a plurality of acoustic leaks 402, 404 (2 shown) are provided in the horn 406 at designated lengths L2 and L3. Each of the leaks 402, 404 may include an acoustic resistive element disposed within or overlying an opening in the horn 406. Once again, the positions L2, L3 of the acoustic leaks 202, 204, as measured from the throat 408 of the horn 406 to the center of the acoustic leak opening, are chosen to damp resonances for a smoothed response. Providing multiple leaks at different locations allows multiple different frequencies to be targeted. As in the implementation illustrated in FIG. 2A, the acoustic leaks are located not for a maximum (most effective) reduction of the respective targeted frequencies, but, instead, to simply reduce the peak in the target frequency enough to provide a smooth response. (i.e., each of the acoustic leaks is spaced away from a point along the length of the horn corresponding to the pressure maximum of the targeted frequency, so as to reduce a peak at the targeted frequency without removing the targeted frequency from the output of the horn).

To the right of the loudspeaker 400 in FIG. 4A is shown a frequency response graph 430. A first plot 432 illustrates an idealized, smooth, flat response. Also shown is a second plot 434 which illustrates the response of the loudspeaker 400 of FIG. 4A in the absence of the acoustic leaks 402, 404. The third plot 436 illustrates the frequency response of the loudspeaker 400 of FIG. 4A with the acoustic leaks 402, 404. By way of comparison, the introduction of the acoustic leaks 402, 404 smooths out comb filtering peaks in the response and make it closer to the idealized response.

Figure 4B:
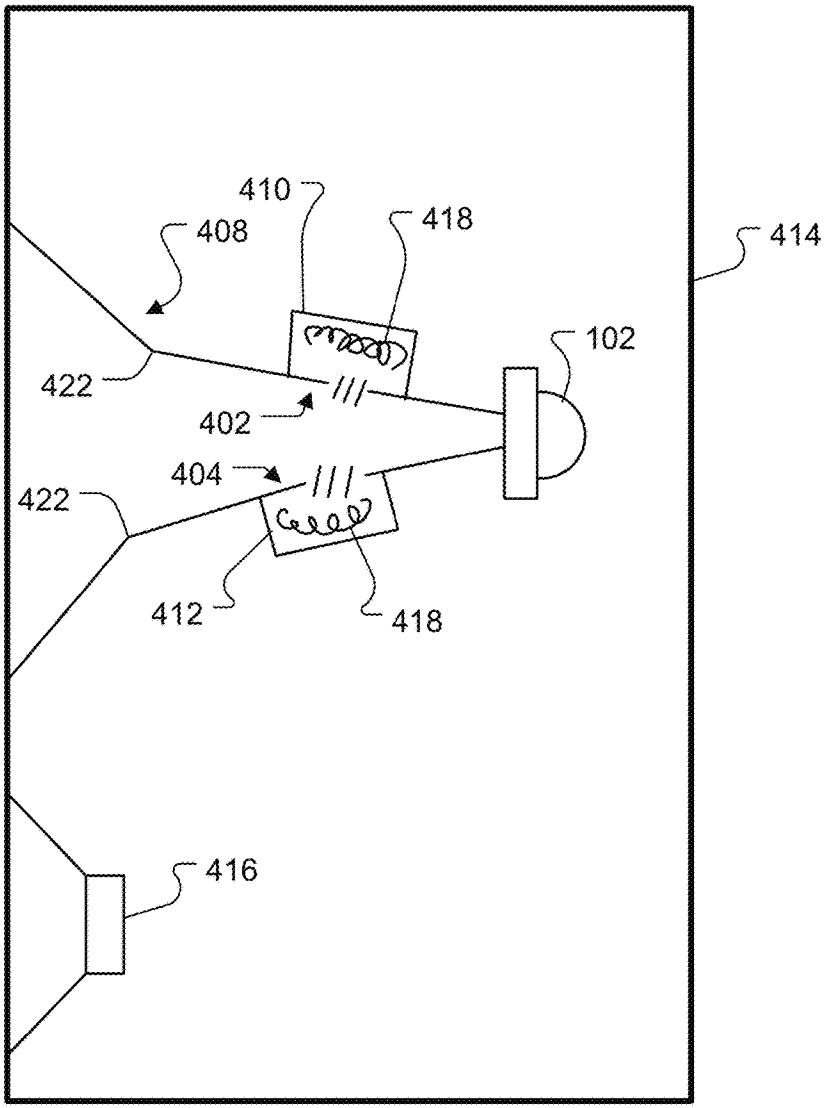
FIG. 4B is a diagrammatic view of the loudspeaker of FIG. 4A integrated into an acoustic enclosure.

The multiple leaks 402, 404 can be vented to open space around the horn, such as illustrated in implementation of FIG. 2A, or, as shown in FIG. 4A, each of the acoustic leaks 402, 404 can be vented into a sealed back enclosure 410, 412. This can be particularly beneficial for implementations in which the horn 406 is integrated into a loudspeaker 400' that includes a speaker box 414 (FIG. 4B) that supports a second electro-acoustic transducer 416 (e.g., a subwoofer) that radiates acoustic energy into the speaker box 414 (a/k/a "acoustic enclosure"). In that regard, the sealed back enclosures 410, 412 can inhibit (e.g., prevent) acoustic energy radiated by the second electro-acoustic transducer 416 from leaking into the horn 406 via the acoustic leaks 402, 404.

In some cases, the sealed back enclosures 410, 412 can be filled with an acoustically absorbent material 418, which can help to broaden out the affected frequency bandwidth. Preferably, the acoustic leaks are located closer to a break 422 (i.e., an interface of two horn sections) or to an end of the horn than to the electro-acoustic transducer. The acoustically absorbent material 418 may include a cotton or synthetic fiber batting, acoustically absorbent foam, etc.

Figure 5A:
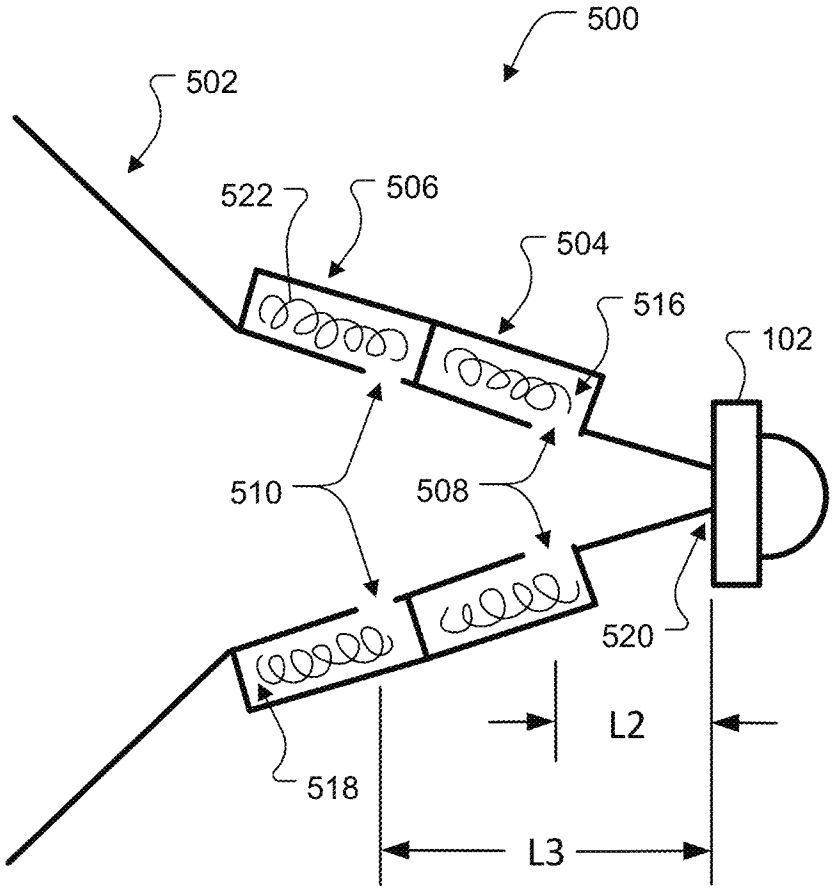
FIG. 5A is a diagrammatic view of an implementation of a horn loudspeaker with acoustic leaks in the form of ¼λ stubs.

FIG. 5A illustrates yet another embodiment of a horn loudspeaker 500 that includes a horn 502 provided with acoustic leaks 504, 506. In the implementation illustrated in FIG. 5A, the acoustic leaks 504, 506 are provided in the form of ¼λ stubs (two shown). Each of the stubs 504, 506 is in the form of a tube that circumferentially surrounds the horn 502. Each stub includes an open end that is acoustically coupled to the horn 502 via one or more apertures 508, 510. The one or more apertures 508, 510 may be in the form of a plurality of openings arranged in a radial array about the inner periphery of the horn (e.g., at location L2 or L3), or in the form of an annular slot (i.e., a continuous open ring).

Each stub 504, 506 also includes a closed end, opposite the open end, and a body that extends substantially parallel to the outer surface of the horn between the open and closed ends. Each of the stubs 504, 506 defines an acoustic channel 516, 518 that has a length (i.e., extending from the open end to the closed end) that is ¼ the wavelength (λ) of the target frequency (i.e., the peak frequency that is to be reduced).

The positions L2, L3 of the acoustic leaks, as measured from the throat 520 of the horn 502 to the center of the acoustic leak opening (i.e., the apertures 508, 510 in FIG. 5A), are chosen to damp resonances for a smoothed response. Providing multiple ¼λ stubs at different locations allows multiple different frequencies to be targeted. The respective locations of the ¼λ stubs are chosen to control the amount the corresponding target frequencies are to be reduced by, and also how well the corresponding acoustic leak couples to that mode. The length of each stub is going to control the frequency that will be reduced, and the location (e.g., L2 or L3) determines how much the target frequency is reduced. As in the implementations described above, the acoustic leaks 504, 506 are located not for a maximum (most effective) reduction of the respective targeted frequencies, but, instead, to simply reduce the peak in the target frequency enough to provide a smooth response. (i.e., each of the acoustic leaks is spaced away from a point along the length of the horn 502 corresponding to the pressure maximum of the targeted frequency, so as to reduce a peak at the targeted frequency without removing the targeted frequency from the output of the horn).

Figure 5B:
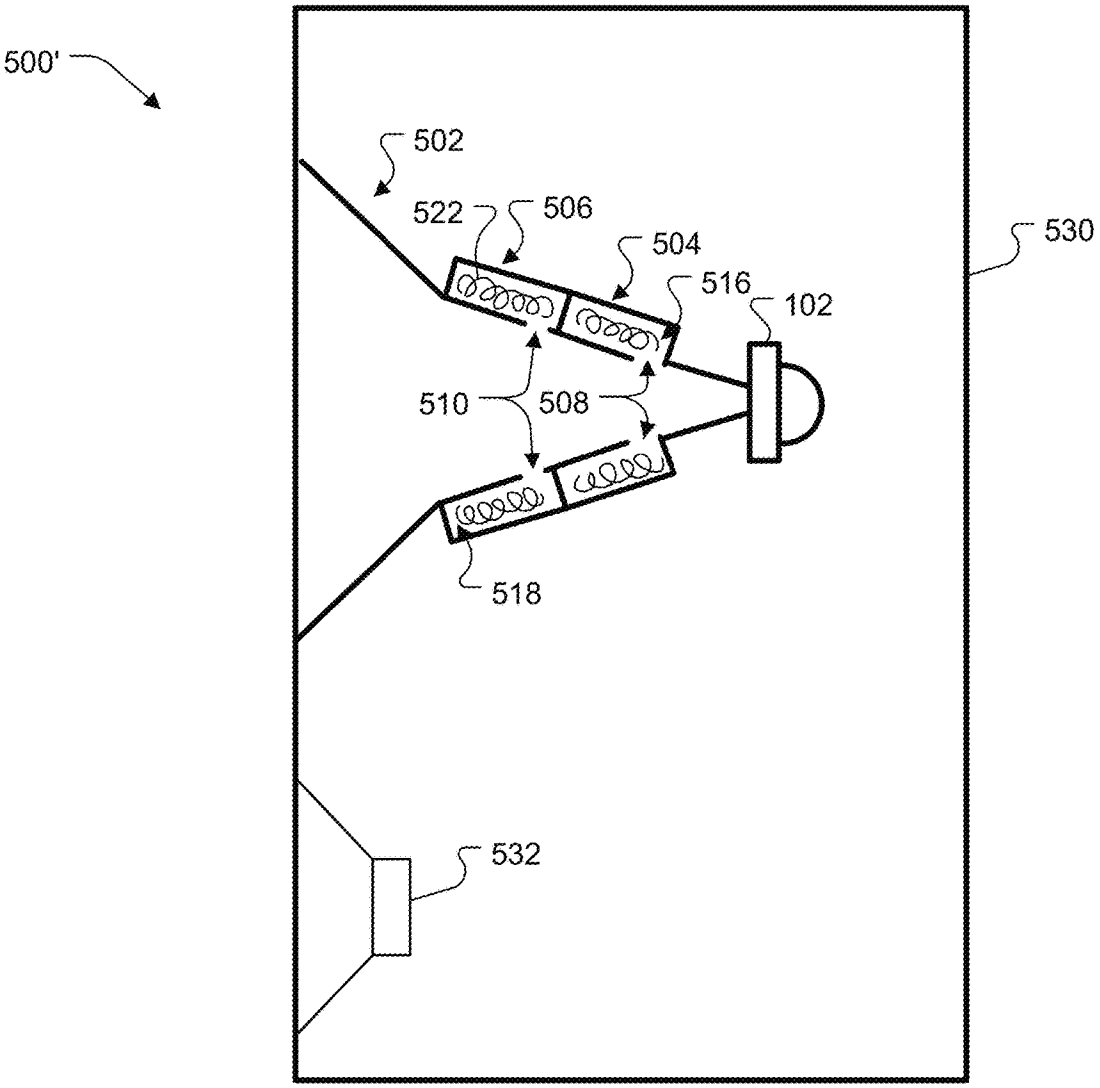
FIG. 5B is a diagrammatic view of the horn loudspeaker of FIG. 5A integrated into an acoustic enclosure.

In some cases, the ¼λ stubs can be filled with an acoustically absorbent material 522, which can help to broaden out the affected frequency bandwidth. Preferably, the ¼λ stubs are located closer to a break (i.e., an interface of two horn sections) or to an end of the horn than to the electro-acoustic transducer. With reference to FIG. 5B, the stubs 504, 506 being closed structures that surround the outer surface of the horn 502 are suitable for use in loudspeaker 500' that includes an acoustic enclosure 530 that supports a low-frequency driver 532, since the stubs 504, 506 themselves will prevent acoustic energy radiated from the low-frequency driver 532 into the enclosure 530 from entering the horn 502, e.g., via the apertures 508, 510. Alternatively, or additionally, the one or more apertures 508, 510 may be covered with an acoustic resistive element, such as described above with reference to FIG. 2A.

Figure 5C:
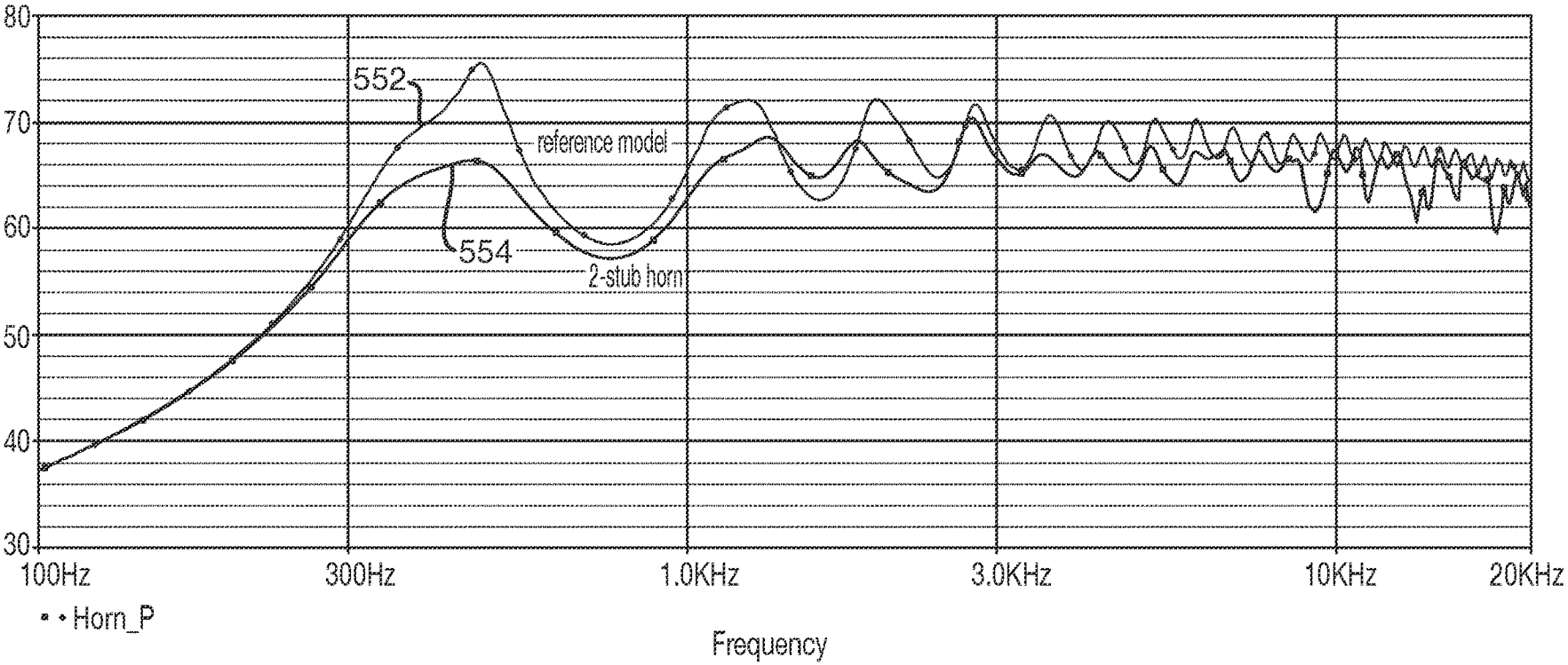
FIG. 5C is a simulated frequency response for a two-section constant directivity horn modeled with two lossy stubs located along a first horn section.

FIG. 5C illustrates a simulated frequency response 550 for a two-section constant directivity horn consisting of an adapter ("first horn section") having an effective length, $L_a$, of 0.158 m coupled to a 100×40 degree, 0.155 m long directivity horn ("second horn section"). For the simulation, two lossy stubs were placed along the adapter length:

Stub1 located at 25% of adapter length from throat and having a stub length of $L_a/2$; and Stub2 located at 60% of adapter length from throat and having a stub length of $L_a/4$.

For this simulation, the adapter was modeled with approximately conical expansion, $h \rightarrow \infty$.

A first plot 552 illustrates the response of the simulated loudspeaker without acoustic leaks. A second plot 554 illustrates the frequency response of the simulated loudspeaker with the acoustic leaks (i.e., stub1 and stub2, described above). As can be seen in the graph, the introduction of the stubs smooths out the comb filtering peaks, most noticeably in the 1 kHz to ~7 kHz range.

Figure 6A:
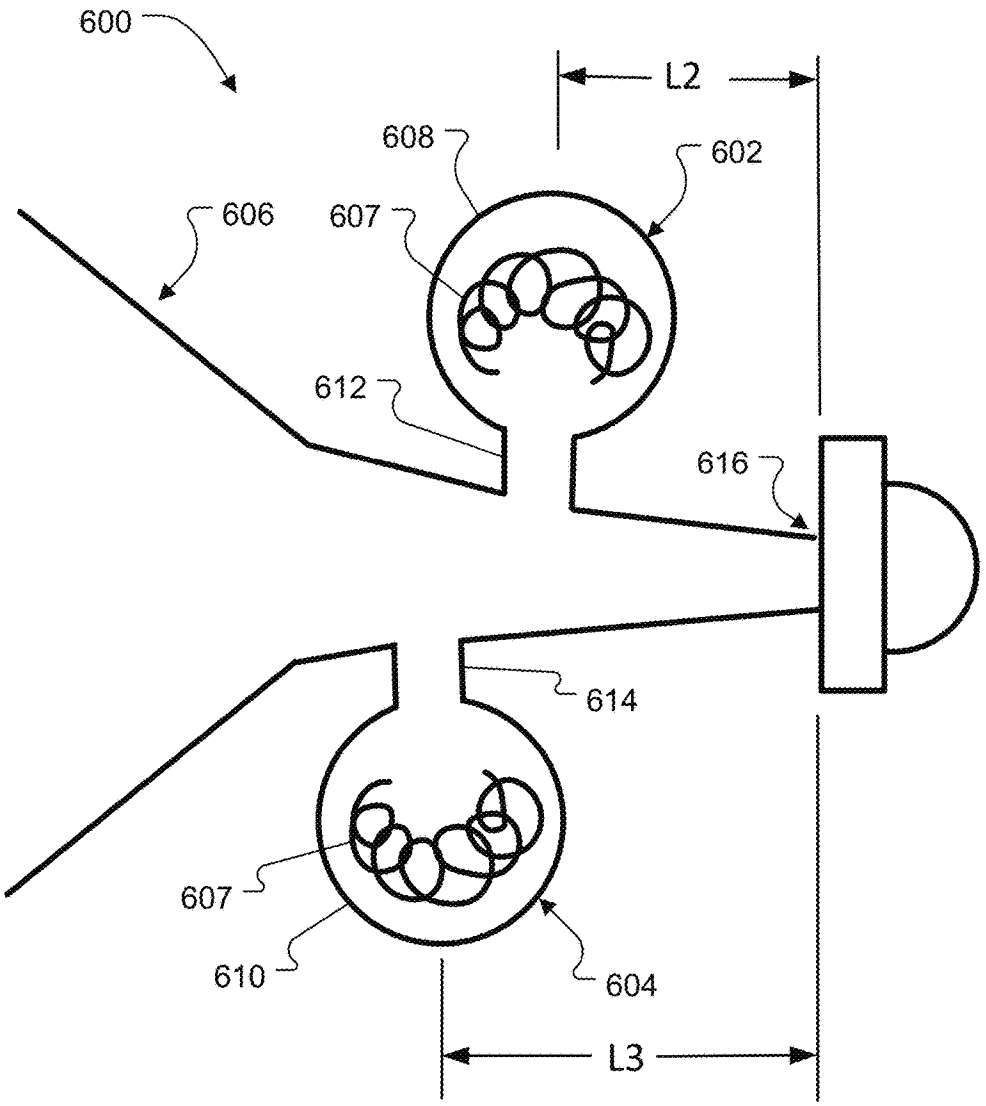
FIG. 6A is a diagrammatic view of an implementation of a horn loudspeaker with acoustic leaks in the form of Helmholtz absorbers.

Yet another implementation of a loudspeaker 600 is illustrated in FIG. 6A. The implementation of FIG. 6A utilizes Helmholtz absorbers 602, 604 positioned along a length of the horn 606, and acoustically coupled thereto. Each of the Helmholtz absorbers includes a Helmholtz resonator containing an acoustically absorptive material 607.

A Helmholtz resonator is an enclosed volume of air 608, 610 with an open hole (or neck or port) 612, 614. Helmholtz resonators are second order resonant acoustic systems. Their resonant behavior comes as a consequence of the compressibility of the air in the enclosure (analogous to a spring) and the inertial characteristics of air in the neck, port, or in the vicinity of the hole (analogous to a mass). A small pressure variation at or near the resonant frequency at the opening to the outside of the Helmholtz resonator will result in a relatively large volume velocity into the neck, port, or hole. The behavior of supporting large volume velocity in response to a small pressure variation at or near the resonant frequency can be thought of as a frequency selective leak. The quality factor (Q) of the resonator can be reduced if desired by either placing a resistive screen over the hole or by including in the enclosure materials known to absorb acoustic energy. If acoustic energy absorbing materials are included in the enclosure, their effect on the apparent compressibility of the air in the enclosure may change the resonant frequency of the Helmholtz resonator, requiring adjustment of some other parameter of the resonator to reestablish the desired resonant frequency.

In the absence of energy absorbing materials in the enclosure, the frequency of the resonance is determined by the formula:

$$f = \frac{c}{2\pi} * \sqrt{\frac{S}{VL}}$$

where f is the frequency, c is the speed of sound in air, S is the surface area of the hole, V is the volume of air in the resonator's body and L is the length of the neck or port. A more accurate prediction of the resonant frequency can be made with an adjustment to L representing the inertial characteristics of the air at the entrance and exit to the port, neck, or hole. The Helmholtz absorbers illustrated in FIG. 6A, the respective tuned frequencies correspond to targeted frequencies that represent acoustic peaks in the loudspeaker response which are targeted to be reduced in order to smooth the response of the loudspeaker.

The positions L2, L3 of the Helmholtz absorbers 602, 604 as measured from the throat 616 of the horn 606 to the center of the acoustic leak opening (i.e., the ports 612, 614 in FIG. 6A), are chosen to damp resonances for a smoothed response. Providing multiple Helmholtz absorbers 602, 604 at different locations allows multiple different frequencies to be targeted. The respective locations, L2 and L3, of the Helmholtz absorbers 602, 604 are chosen to control the amount the corresponding target frequencies are to be reduced by, and also how well the corresponding acoustic leak couples to that mode. As in the implementations described above, the acoustic leaks (are located not for a maximum (most effective) reduction of the respective targeted frequencies, but, instead, to simply reduce the peak in the target frequency enough to provide a smooth response. (i.e., each of the ports 612, 614 is spaced away from a point along the length of the horn 606 corresponding to the pressure maximum of the targeted frequency, so as to reduce a peak at the targeted frequency without removing the targeted frequency from the output of the horn).

The acoustically absorbent material 607, contained in the volume of the Helmholtz resonator, can help to broaden out the affected frequency bandwidth, effectively lowering the quality factor, Q, of the Helmholtz resonator. Preferably, the Helmholtz absorbers 602, 604 are located closer to a break 618 (i.e., an interface of two horn sections that evidences at sharp change in flare angle or radius of curvature) or to an end of the horn than to the electro-acoustic transducer. Alternatively, or additionally, one or more of the ports 612, 614 may be covered by an acoustic resistive element, such as described above, e.g., with reference to FIG. 2A.

Figure 6B:
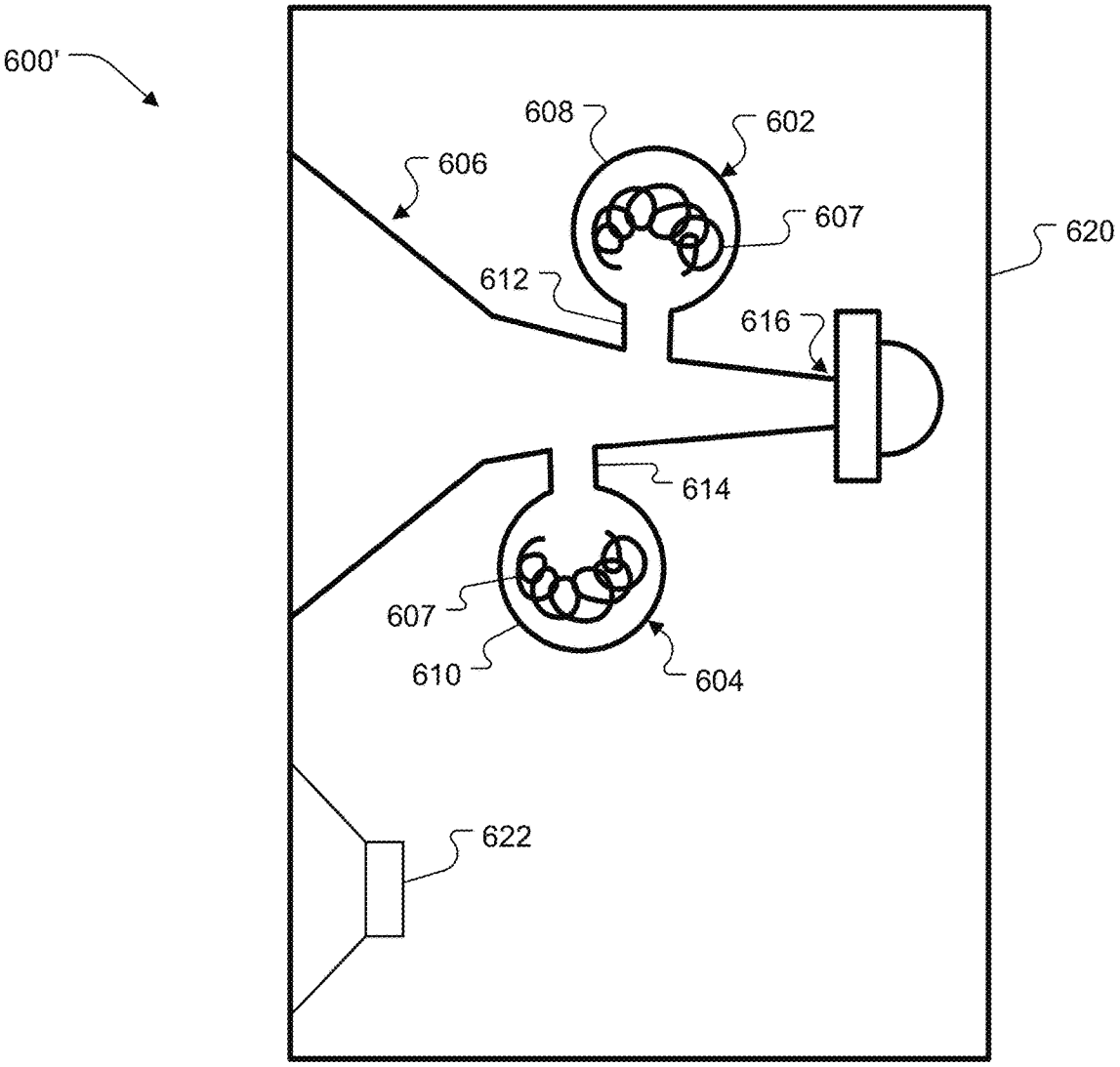
FIG. 6B is a diagrammatic view of the horn loudspeaker of FIG. 6A integrated into an acoustic enclosure.

With reference to FIG. 6B, the Helmholtz absorbers 602, 604 being closed structures that surround the outer surface of the horn 606 are suitable for use in loudspeaker 600' that includes an acoustic enclosure 620 that supports a low-frequency driver 622, since the Helmholtz absorbers 602, 604 themselves will prevent acoustic energy radiated from the low-frequency driver 622 into the enclosure 620 from entering the horn 606, e.g., via the ports 612, 614.

A number of implementations have been described. Nevertheless, it will be understood that additional modifications may be made without departing from the scope of the inventive concepts described herein, and, accordingly, other implementations are within the scope of the following claims.

What is claimed is:

1. A loudspeaker comprising:

a first electro-acoustic transducer;

a horn acoustically coupled to the first electro-acoustic transducer; and a first acoustic leak acoustically coupled to the horn, wherein the first acoustic leak is positioned so as to reduce a peak in a frequency response of the loudspeaker at a targeted frequency without removing the targeted frequency from the output of the loudspeaker, and wherein the first acoustic leak comprises a stub that defines an acoustic channel that has a length that is ¼ the wavelength (λ) of the target frequency, the ¼ λ stub further being in the form of a tube that circumferentially surrounds the horn.

2. The loudspeaker of claim 1, wherein the first acoustic leak comprises an acoustic resistive element.

3. The loudspeaker of claim 2, wherein the first acoustic leak further comprises a sealed back enclosure disposed along an outer surface of the horn.

4. The loudspeaker of claim 1, wherein the first acoustic leak further comprises an acoustically absorbent material disposed within the acoustic channel, wherein the acoustically absorbent material broadens out the affected frequency bandwidth, effectively lowering the quality factor, Q, of the first acoustic leak.

5. The loudspeaker of claim 4, wherein the acoustically absorbent material comprises a cotton batting, a synthetic fiber batting, or an acoustically absorbent foam.

6. The loudspeaker of claim 1, wherein the ¼λ stub includes an open end that is acoustically coupled to the horn via one or more apertures, a closed end, opposite the open end, and a body that extends substantially parallel to the outer surface of the horn between the open and closed ends.

7. The loudspeaker of claim 1, wherein the ¼λ stub comprises an acoustically absorbent material disposed within the acoustic channel, wherein the acoustically absorbent material broadens out the affected frequency bandwidth, effectively lowering the quality factor, Q, of the first acoustic leak.

8. The loudspeaker of claim 7, wherein the acoustically absorbent material comprises a cotton batting, a synthetic fiber batting, or an acoustically absorbent foam.

9. The loudspeaker of claim 1, wherein the first acoustic leak comprises a Helmholtz absorber comprising:

an enclosed volume;

a port having a first end that is acoustically coupled to the horn and a second end, opposite the first end, that is acoustically coupled to the enclosed volume; and an acoustically absorbent material disposed within the Helmholtz absorber.

10. The loudspeaker of claim 9, wherein the acoustically absorbent material comprises a cotton batting, a synthetic fiber batting, or an acoustically absorbent foam.

11. The loudspeaker of claim 1, further comprising a second acoustic leak, wherein the first acoustic leak and the second acoustic leak are configured for reducing different, respective peaks in the output of the loudspeaker.

12. The loudspeaker of claim 11, wherein the horn includes a first horn section and a second horn section, wherein the first acoustic leak is configured to reduce a first peak in the output of the loudspeaker corresponding to a first resonance in the first horn section and the second acoustic leak is configured to reduce a second peak in the output of the loudspeaker corresponding to a second resonance in the second horn section.

13. The loudspeaker of claim 12, wherein the first and second acoustic leaks are arranged in the first horn section.

14. The loudspeaker of claim 1, wherein the horn includes a first horn section and a second horn section.

15. The loudspeaker of claim 14, wherein the first acoustic leak is disposed in first horn section.

16. The loudspeaker of claim 14, wherein the first acoustic leak is arranged such that it is closer to an interface of first and second horn sections than it is to the first electro-acoustic driver.

17. The loudspeaker of claim 2, wherein the acoustic resistive element comprises a metallic screen.

18. The loudspeaker of claim 1, further comprising an acoustic enclosure, and a second electro-acoustic transducer, wherein the first electro-acoustic transducer, the horn, and the second electro-acoustic transducer are supported in the acoustic enclosure.

19. The loudspeaker of claim 18, wherein the first electro-acoustic transducer is a high-frequency driver and second electro-acoustic transducer is a low-frequency driver.

* * * * *